US009400455B2

(12) United States Patent
Cannon et al.

(10) Patent No.: US 9,400,455 B2
(45) Date of Patent: Jul. 26, 2016

(54) IMAGING DEVICE HAVING AN ADAPTABLE CLEANING SYSTEM

(71) Applicant: Lexmark International, Inc., Lexington, KY (US)

(72) Inventors: Roger S Cannon, Nicholasville, KY (US); Kerry L Embry, Midway, KY (US); Heidi L Hays, Lexington, KY (US); William Claiborne Ryle, Williamstown, KY (US); Julie Ann Gordon Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/934,091

(22) Filed: Jul. 2, 2013

(65) Prior Publication Data

US 2015/0010318 A1 Jan. 8, 2015

(51) Int. Cl.
*G03G 15/00* (2006.01)
*G03G 15/16* (2006.01)

(52) U.S. Cl.
CPC ..... *G03G 15/161* (2013.01); *G03G 2221/0015* (2013.01)

(58) Field of Classification Search
CPC ..... G03G 15/161; G03G 2221/0005; G03G 2221/0015
USPC ..... 399/71, 101, 349
See application file for complete search history.

(56) References Cited

U.S. PATENT DOCUMENTS

| | | | | |
|---|---|---|---|---|
| 5,073,800 | A * | 12/1991 | Yamaguchi et al. | 399/150 |
| 7,392,007 | B2 * | 6/2008 | Nakano et al. | 399/345 |
| 7,457,578 | B2 * | 11/2008 | Lundy et al. | 399/349 |
| 7,546,071 | B2 * | 6/2009 | Inoue et al. | 399/284 |
| 7,826,764 | B2 * | 11/2010 | Takahashi | G03G 15/161 399/101 |
| 7,929,878 | B1 * | 4/2011 | Thayer et al. | 399/71 |
| 2007/0147863 | A1 * | 6/2007 | Takahashi | 399/49 |
| 2008/0008483 | A1 * | 1/2008 | Hamaya et al. | 399/44 |
| 2008/0050140 | A1 * | 2/2008 | Oku | B41J 2/0057 399/71 |
| 2009/0232539 | A1 * | 9/2009 | Nozawa | G03G 15/161 399/101 |
| 2010/0046997 | A1 * | 2/2010 | Gross et al. | 399/346 |
| 2010/0247123 | A1 * | 9/2010 | Honjoh et al. | 399/44 |
| 2011/0097105 | A1 * | 4/2011 | You | G03G 15/0131 399/101 |

* cited by examiner

*Primary Examiner* — Clayton E Laballe
*Assistant Examiner* — Trevor J Bervik

(57) ABSTRACT

An imaging device includes a moving surface for transferring a developed toner image during an image transfer operation, a sensing unit for detecting the amount of residual toner remaining on the moving surface after the image transfer operation, and a cleaning unit for selectively cleaning the residual toner from the moving surface. A controller coupled to the sensing unit and the cleaning unit selectively adjusts an operating characteristic of the cleaning unit based on the amount of residual toner detected by the sensing unit.

9 Claims, 5 Drawing Sheets

IMAGING DEVICE HAVING AN ADAPTABLE CLEANING SYSTEM

CROSS REFERENCES TO RELATED APPLICATIONS

The present application is related to and claims priority under 35 U.S.C. 119(e) from U.S. provisional application No. 61/801,343, filed Mar. 15, 2013, entitled, "Imaging Device Having an Adaptable Cleaning System," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

This invention relates to an electrophotographic printer having an imaging device, and, more particularly, to an adaptable cleaning system for removing residual toner from a toner transferring surface of the imaging device.

2. Description of the Related Art

In an electrophotographic process, toner is transferred by electrostatic means to an intermediate transfer member (ITM) belt at each of four or more successive imaging stations each representing a different color plane. Toner is accumulated onto the ITM belt and then transferred onto a media sheet by reversing the electrostatic field. This transfer onto paper is not 100 percent efficient, and some small amount of toner is left on the ITM belt that needs to be removed prior to a subsequent image to be accumulated on the ITM belt.

In most situations the amount of residual toner on the ITM belt is extremely small, amounting to only about 2 to 5 percent of the toner that was available for transfer, which is normally only a small percentage of the total toner that could be transferred. A polymer cleaner blade, typically made of urethane, is commonly used to remove this residual toner. The cleaner blade skives the ITM belt thereby scraping off toner which ends up in an augured channel and is then carried to a waste container. This system can usually be designed to clean all of the residual toner from the ITM belt even when very high amounts of toner is present.

However, over time as printers become faster and as components will be desired to have a longer life, a cleaner blade system can create problems. Due to higher friction and torque on the system, the cleaner blade and the ITM belt can have a variety of life-failures. One common failure mode, especially for ITM belts without a hard, easy-to-release toner surface such as polyethylenetetrafluoroethylene (ETFE) or thermoplastic elastomer (TPE), is filming which can cause streaks to appear in the printed images. Filming also causes variations in electrical properties of the ITM belt over the course of a long print job. Further, the pressure of the blade on the ITM belt can cause lines of irregular densities to appear in a full-page or solid print. The ITM belt can eventually wear whereby coating from the ITM belt surface is removed in spots. Meanwhile, when the cleaner blade wears out, its cleaning ability is diminished which results in dirty printed images.

Since the ITM belt is a component of some amount of significance in ensuring superior print quality, the ITM belt is specially manufactured to meet several performance requirements. In general terms, the ITM belt has a relatively hard, smooth surface for good release properties and excellent cleanability. Its material generally has a relatively low compression set, a relatively high strength, low elongation, a resistance to cracks and wear, and excellent electrical properties. Since these performance requirements increase the cost of the material and manufacture of the ITM belt, it is desirable for the ITM belt to have a relatively long life.

SUMMARY

Example embodiments overcome shortcomings of existing electrophotographic imaging devices and satisfy a significant need for an adaptable cleaning system to prolong the life of the imaging device. According to an example embodiment, there is shown an imaging device having a moving surface for transferring a developed toner image during an image transfer operation. The imaging device includes a sensing unit for detecting the amount of residual toner remaining on the moving surface after the image transfer operation is complete and a cleaning unit for cleaning the residual toner from the moving surface. A controller coupled to the sensing unit and the cleaning unit selectively adjusts an operating characteristic of the cleaning unit based on the amount of residual toner detected by the sensing unit.

The imaging device may also include a cleaning unit positioning mechanism coupled to the cleaning unit to move the cleaning unit into a position wherein the cleaning unit engages the moving surface when the amount of residual toner detected by the sensing unit exceeds a threshold value, and move or otherwise maintain the cleaning unit in a disengaged position a spaced distance from the moving surface when the amount of residual toner detected by the sensing unit is less than a threshold value.

The cleaning unit may include a rotatable brush and a blade wherein the brush is used when the amount of residual toner detected by the sensing unit falls below the threshold value and the blade is used along with the brush only when the amount of residual toner detected by the sensing unit exceeds the threshold value. The rotatable brush may be positioned downstream of the blade along the moving surface.

In another example embodiment, the controller is operative to move a section of the moving surface, without performing image transfer, for further cleaning by the cleaning unit based on the amount of residual toner detected by the sensing unit. As such, the cleaning unit cleans the moving surface in one pass when the amount of residual toner detected by the sensing unit falls below the threshold value, and in two passes of the moving surface when the amount of residual toner detected by the sensing unit exceeds the threshold value.

The sensing unit may be positioned upstream or downstream of the cleaning unit along the moving surface according to its intended use. The sensing unit may be positioned upstream the cleaning unit to be able to sense the amount of residual toner immediately after the transfer operation, prior to any cleaning, and determine whether cleaning is necessary. Alternatively, the sensing unit may be positioned downstream the cleaning unit in order to be able to assess the efficiency of a first pass of cleaning.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
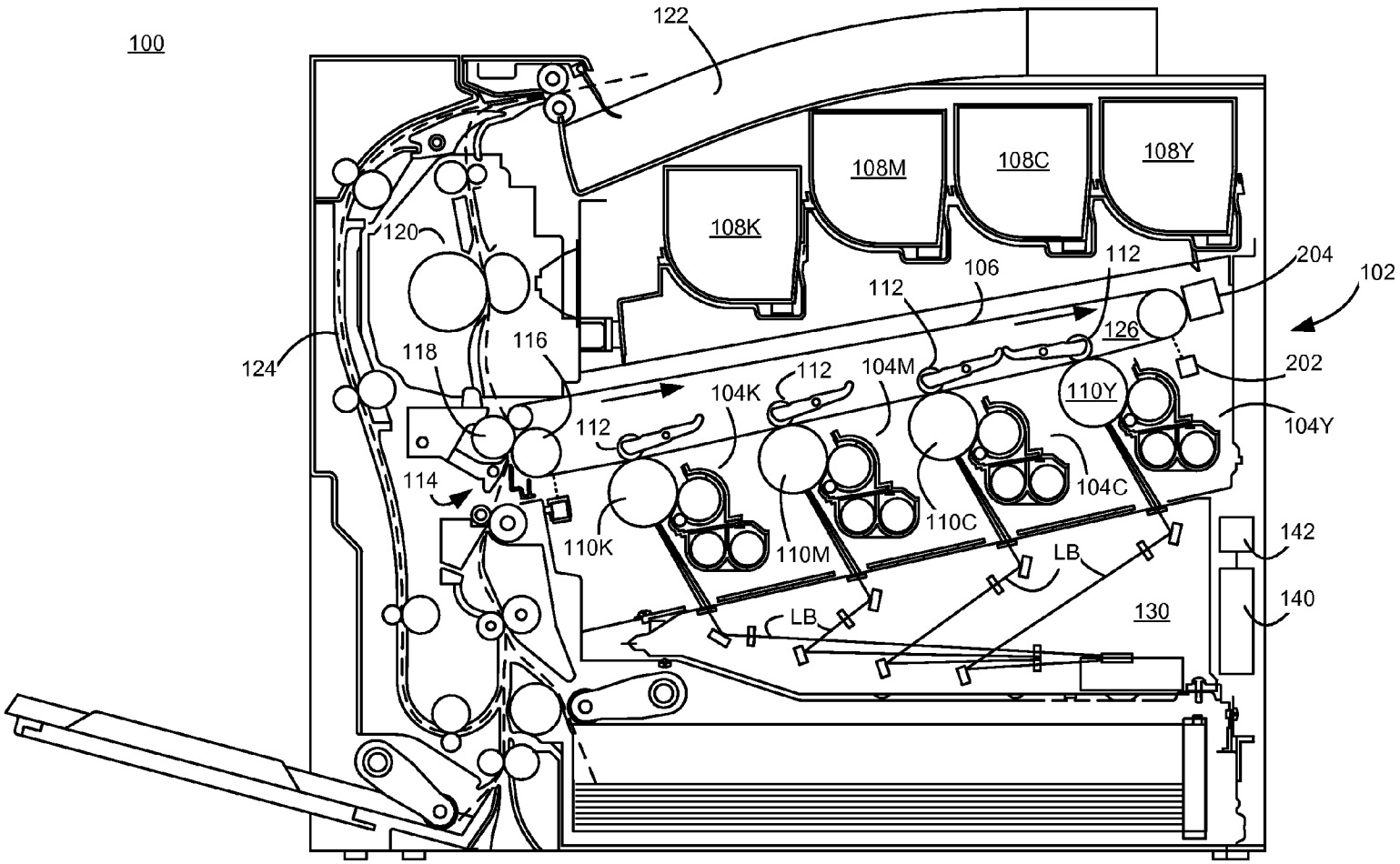
FIG. 1 is a side view of a color electrophotographic printer with an ITM belt and cleaning assembly according to example embodiments of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first transfer area 102 having four developer units 104 that substantially extend from one end of image forming device 100 to an opposed end thereof. Developer units 104 are disposed along an intermediate transfer member (ITM) belt 106. Each developer unit 104 holds a different color toner. Developer units 104 may be aligned in order relative to the direction of ITM belt 106 indicated by the arrows in FIG. 1, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in an imaging operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead 130 is directed to the surface of each photoconductive member 110 and discharges those areas it contacts to form a latent image thereon. In one example embodiment, areas on the photoconductive member 110 illuminated by the laser beam LB are discharged to approximately −100 volts. Each of developer units 104 then transfers toner to its corresponding photoconductive member 110 to form a toner image thereon. The toner is attracted to the areas of the surface of photoconductive member 110 that are discharged by the laser beam LB from the printhead 130.

ITM belt 106 is disposed adjacent to each developer unit 104. In this example embodiment, ITM belt 106 is formed as an endless belt disposed about a drive roller and other rollers. During image forming operations, ITM belt 106 moves past photoconductive members 110 in a clockwise direction as viewed in FIG. 1. One or more of photoconductive members 110 applies its toner image in its respective color to ITM belt 106. For mono-color images, a toner image is applied from a single photoconductive member 110K. For multi-color images, toner images are applied from two or more photoconductive members 110. In one example embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

In preparation for the next image forming operation, ITM belt 106 is cleaned of residual toner by a cleaning unit 204. Removal of the residual toner is necessary prior to preparing ITM belt 106 to receive a new image otherwise the residual toner may be carried over the succeeding image forming operation and will result in a dirty printed image. As shown, a toner patch sensor (TPS) 202 may be provided in the image forming device 100 to assess the quantity of residual toner and provide feedback for determining whether or not to adjust an operating characteristic of cleaning unit 204. TPS 202 may emit and reflect light off of a portion of ITM belt 106 to determine how much toner was not transferred during the transfer process. TPS 202 may include a light source providing light and a detector which may be sensitive to the emitted or luminescent, fluorescent and/or phosphorescent light. Light sources may include LED, lasers, incandescent lights, etc. Detectors may include various optical detectors, such as photoresistors, photodiodes, etc.

Cleaning unit 204 may be a cleaning brush, a cleaner blade, or a combination of both cleaner brush and cleaner blade, as described below. In particular, a cleaning brush is a rotatable roll having bristles driven to engage ITM belt 106 and rotate in a direction opposite the rotation of ITM belt 106. Residual toner particles and other particulate debris, such as paper dust, are mechanically scrubbed from ITM belt 106 and picked up into the bristles of the cleaning brush as the cleaner brush rotates. In addition to mechanical scrubbing, an electrical bias may be applied to the cleaning brush to electrostatically attract the residual toner to the cleaning brush fibers. On the other hand, cleaner blades are conventionally formed with a sheet metal bracket and a flexible elastomer member adhered to one end the bracket in a cantilevered manner. The flexible member is deflected and pressed against the surface of ITM belt 106 such that as ITM belt 106 rotates, the cleaner blade skives off the residual toner from ITM belt 106.

Image forming device 100 further includes a controller 140 and memory 142 communicatively coupled thereto. Though not shown in FIG. 1, controller 140 may coupled to components and modules in image forming device 100 for controlling same. For instance, controller 140 may be coupled to toner reservoirs 108, developer units 104, photoconductive members 110, fuser 120, a drive mechanism 126 for ITM belt 106, printhead 130, TPS 202, and cleaning unit positioning mechanism 206. It is understood that controller 140 may be implemented as any number of controllers and/or processors for suitably controlling image forming device 100 to perform, among other functions, printing operations.

FIGS. 2A-2D contemplate example embodiments of an adaptable cleaning system that can be adapted to deliver effective cleaning when necessary and gentler cleaning to ITM belt 106 most other times. As contemplated herein, such adaptable cleaning systems may use toner having colorants (pigments and/or dyes) that are treated to be luminescent, fluorescent and/or phosphorescent within a certain range of light frequencies, such as the infrared region. One example toner composition having luminescent, fluorescent and/or phosphorescent colorants used for monitoring toner density is the toner composition as described in U.S. Pat. No. 7,894,732, assigned to the assignee of this application, the teachings of which are incorporated by reference herein in its entirety.

Figure 2A:
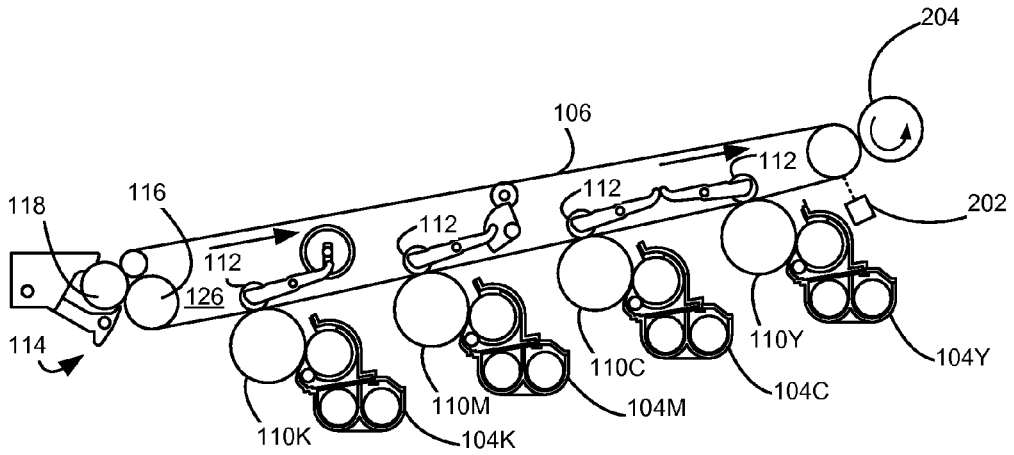
FIGS. 2A-2D show cleaning assemblies for cleaning the ITM belt assembly of FIG. 1 according to various example embodiments.

FIG. 2A depicts cleaning unit 204 having a rotatable cleaner brush positioned to always engage a section of ITM belt 106 in order to remove residual toner from ITM belt 106 prior to preparing ITM belt 106 to receive a new image. The cleaner brush of cleaning unit 204 preferably rotates in the direction opposite the rotation of ITM belt 106 and may be provided with an electrical charge opposite that of the toner to attract the residual toner to the fibers of the cleaning brush during cleaning. Compared to conventional cleaner blade belt cleaning systems, the cleaner brush is less effective in cleaning than the cleaner blade but is less abrasive and as such is able to extend the life of ITM belt 106. As shown, TPS 202 may be positioned downstream of the cleaner brush of cleaning unit 204 to assess the efficiency of the cleaning performed. When ITM belt 106 is determined by controller 140 to have been inadequately cleaned based on the signal provided by TPS 202 indicative of the amount of residual toner remaining on ITM belt 106 after cleaning, controller 140 may control ITM belt drive 126 to cycle ITM belt 106 for a second pass of cleaning without image transfer being performed. Further, controller 140 may increase at least one of operating speed and operating voltage of the cleaner brush of cleaning unit 204 to improve its cleaning ability during the second pass of cleaning. On the other hand, when the signal provided by TPS 202 indicates that amount of residual toner remaining on ITM belt 106 after cleaning does not require additional cleaning, controller 140 may cause the next image transfer operation to be performed.

Figure 2B:
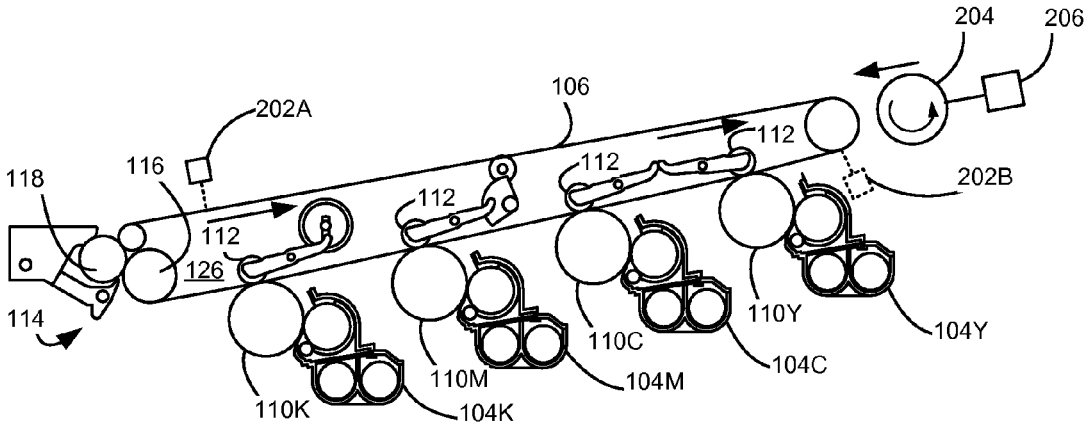

Referring now to FIG. 2B, there is shown cleaning unit 204 having a retractable cleaner brush positioned away from contact with ITM belt 106 in its normal, default position. Cleaning unit 204 is coupled to cleaning unit positioning mechanism 206 controlled by controller 140 to move the cleaner brush into and out of engagement with ITM belt 106 based on the signal provided by TPS 202A indicative of the amount of residual toner on ITM belt 106. TPS 202A is positioned upstream of the cleaning unit 204 in order to assess the amount of residual toner left on ITM belt 106 after image transfer. When controller 140 determines that the amount of residual toner on ITM belt 106 requires cleaning to be performed prior to a subsequent image forming operation based on the signal provided by TPS 202A, controller 140 controls cleaning unit positioning mechanism 206 to move the cleaner unit 204 to come into contact with ITM belt 106, and controls cleaner unit 204 to thereafter clean ITM belt 106.

Further, when the signal provided by TPS 202A indicates that the amount of residual toner remaining on ITM belt 106 following toner transfer does not require cleaning of ITM belt 106, the next image transfer operation may then be performed without any cleaning. Compared to the example embodiment shown in FIG. 2A as described above, the cleaner unit 204 in the example embodiment shown in FIG. 2B is selectively made to clean ITM belt 106 only after a determination that cleaning is necessary. As such, the example embodiment described in FIG. 2B has a less abrasive cleaner unit 204 and can better extend the life of ITM belt 106. The retractable cleaner brush cleaning unit as described is best used when it is known that the image forming device 100 normally has high image transfer efficiency such that the amount of residual toner on ITM belt 106 after image transfer usually does not necessitate cleaning thereof.

Further, while the example embodiment in FIG. 2B shows TPS 202A for assessing the amount of residual toner left on ITM belt 106 after image transfer, in another contemplated example embodiment, TPS 202B may be used in place of TPS 202A. According to this alternative example embodiment, the amount of residual toner left on ITM belt 106 after image transfer is first sensed by TPS 202B without performing cleaning and based on the assessment made by controller 140 on the signal provided by TPS 202B, the controller 140 may control ITM belt drive 126 to cycle ITM belt 106 without image transfer being performed, control cleaning unit positioning mechanism 206 to move the cleaner unit 204 to come into contact with ITM belt 106, and control cleaner unit 204 to clean ITM belt 106. Further, controller 140 may increase at least one of operating speed and operating voltage of the cleaner unit 204 to improve its cleaning ability.

In yet another alternative example embodiment, both TPS 202A and TPS 202B are used to sense the amount of residual toner on the ITM belt 106 pre-cleaning and post-cleaning, respectively. TPS 202A is positioned upstream of the cleaning unit 204 in order to assess the amount of residual toner left on ITM belt 106 after image transfer while TPS 202B is positioned downstream of the cleaning unit 204 to assess the efficiency of any cleaning that is performed. Use of TPS 202A upstream of cleaner unit 204 allows for determining when to move the cleaner brush into engagement with ITM belt 106 for performing a cleaning operation. Use of TPS 202B downstream of cleaner unit 204 allows for detecting residual toner levels on ITM belt 106 following the cleaning operation to ensure that ITM belt 106 is adequately clean before a subsequent imaging operation can be performed. However, when ITM belt 106 is determined by controller 140 to have been inadequately cleaned based on the signal provided by TPS 202B, controller 140 may control ITM belt drive 126 to cycle ITM belt 106 for a second pass of cleaning without image transfer being performed.

Figure 2C:
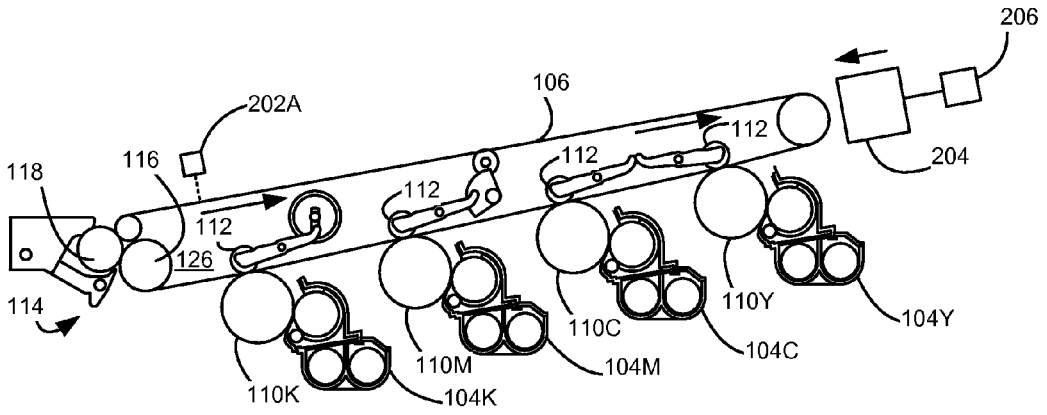

FIG. 2C depicts cleaning unit 204 having a retractable cleaner blade positioned away from contact with ITM belt 106 in its normal, default position. Similar to the cleaning brush discussed with reference to FIG. 2B, the cleaner blade may be moveable to engage with and disengage from ITM belt 106 by cleaning unit positioning mechanism 206 based on the assessment by controller 140 as to whether the amount of residual toner on ITM belt 106 after image transfer is at an acceptable level. When controller 140 determines that the amount of residual toner on ITM belt 106 requires cleaning to be performed prior to a subsequent image forming operation based on the signal provided by TPS 202A, controller 140 may control cleaning unit positioning mechanism 206 to move the cleaner unit 204 to engage with ITM belt 106 and control cleaner unit 204 to clean ITM belt 106. Otherwise, when controller 140 determines that the signal provided by TPS 202A indicates that the amount of residual toner remaining on ITM belt 106 is sufficiently low and does not require cleaning, the next image transfer operation may then be performed without any cleaning activity being undertaken. Unlike some cleaner brush systems, a retractable cleaner blade cleaning unit as shown in FIG. 2C may not need a TPS downstream of the cleaning unit 204 for assessing the cleanliness of ITM belt 106 after cleaning. This is because the cleaner blade of cleaner unit 204 of FIG. 2C is able to effectively scrape off substantially all residual toner from ITM belt 106. Further, since the cleaner unit 204 selectively cleans ITM belt 106 only after a determination that cleaning is necessary, the above-described example embodiment has a less abrasive cleaner unit 204 and can better extend the life of ITM belt 106 compared to conventional cleaner blade systems.

Figure 2D:
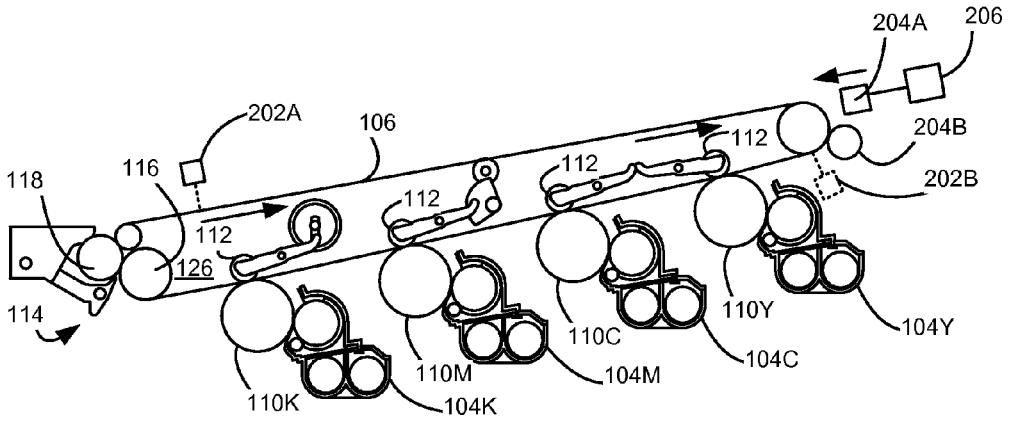

In FIG. 2D, the cleaning unit includes two cleaner members 204A and 204B. In this example embodiment, TPS 202A is positioned upstream of cleaning units 204A and TPS 204B is optionally disposed along ITM belt 106 downstream thereof. First cleaning unit 204A is positioned upstream to second cleaning unit 204B along ITM belt 106. In this example embodiment, first cleaning unit 204A is a retractable cleaner blade positioned away from contact with ITM belt 106 in its normal, default position and is operably connected to cleaning unit positioning mechanism 206 which is controlled by controller 140. Cleaning unit positioning mechanism 206 selectively moves the cleaner blade 204A into engagement with ITM belt 106 only when a more thorough cleaning is deemed necessary by controller 140. Second cleaning unit 204B, which may be a cleaning brush, is non-translatable relative to ITM belt 106 and as such substantially always cleans ITM belt 106 following an imaging operation.

When the cleaner blade 204A is moved into contact with ITM belt 106 for performing a more thorough cleaning, ITM belt 106 is first cleaned by the cleaning blade 204A and then by the cleaning brush 204B. First cleaner blade 204A performs the first cleaning of ITM belt 106 so that there is sufficient amount of residual toner on ITM belt 106 to provide lubrication for the cleaner blade 204A and minimize abrasion of ITM belt 106. Cleaner blade 204A cleaning ITM belt 106 prior to cleaning by cleaner brush 204B also may ensure that a line of toner that may be formed by cleaner blade 204A making and/or breaking contact with ITM belt 106 is thereafter cleaned by cleaner brush 204B. After cleaning, ITM 106 is ready for the next image transfer operation to be performed. On the other hand, when the amount of residual toner detected by TPS 202A is at a level which does not require a thorough cleaning of ITM belt 106, controller 140 does not activate cleaning unit positioning mechanism 206 to engage the cleaner blade 204A with ITM belt 106, such that only cleaner brush 204B cleans ITM belt 106. In this way, the example embodiment described in FIG. 2D contemplates an adaptable cleaning system that can deliver both aggressive, thorough cleaning only when necessary, and less abrasive or gentler cleaning otherwise.

In another contemplated example embodiment, TPS 202B may be used in place of TPS 202A. Accordingly to this alternative example embodiment, the amount of residual toner left on ITM belt 106 after initial cleaning by cleaner brush 204B is sensed by TPS 202B and based on the assessment made by controller 140 on the signal provided by TPS 202B indicative that further cleaning is required, the controller 140 may control ITM belt drive 126 to cycle ITM belt 106 without image transfer being performed, control cleaning unit positioning mechanism 206 to move the cleaner unit 204A to come into contact with ITM belt 106, and control cleaner blade 204A to clean ITM belt 106 during a second pass of cleaning.

With continued reference to FIG. 2D, in another example embodiment, cleaner blade 204A may be positioned downstream of cleaner brush 204B. To ensure a sufficient amount of toner is on ITM belt 106 when cleaned by cleaner blade 204A so as to avoid ITM belt 106 from prematurely wearing, the voltage on cleaner brush 204B may be turned off or even reversed to force an amount of toner back to the ITM belt 106 from cleaner brush 204B to the lubricate the blade during initial blade engagement. Cleaner blade 204A making and breaking contact may then be timed to occur in the interpage gap, for instance, to avoid any toner deposited onto ITM belt 106 from appearing on a media sheet.

In summary, in the example embodiments illustrated in FIGS. 2A-2D, TPS 202 may be positioned upstream and/or downstream of the cleaning unit 204 depending on its intended use. TPS 202A is positioned upstream the cleaning unit 204 in order to be able to sense the amount of residual toner immediately after the transfer operation, prior to any cleaning, and determine whether cleaning is necessary. TPS 202B is positioned downstream of the cleaning unit 204 in order to be able to assess the efficiency of a first pass of cleaning.

Figure 3:
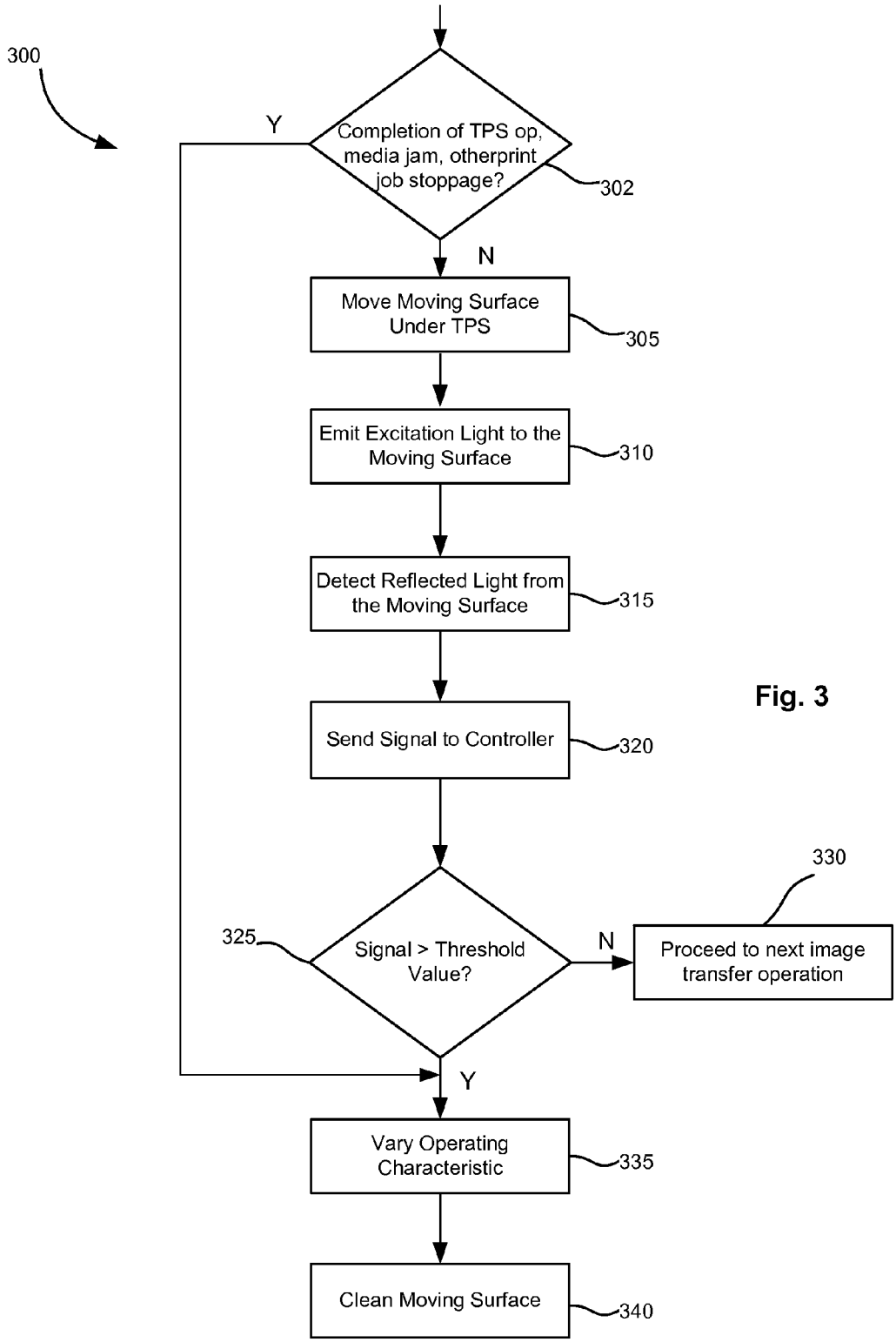
FIG. 3 is a flow diagram of a method of cleaning residual toner from the ITM belt according to example embodiments.

A method of using an adaptable cleaning system will now be described with reference to the flow chart shown in FIG. 3. At block 305, a portion of ITM belt 106 is rotated by controller 140 to move away from the second transfer area 114 and towards an area directly below TPS 202. This may occur following an image transfer operation in which toner is transferred from ITM belt 106 to a media sheet at second transfer area 114. At block 310, light may be provided by TPS 202 to the portion of ITM belt 106. At block 315, light reflected by the residual toner may be detected by the TPS 202, indicative of an amount of residual toner remaining on ITM belt 106. It may be understood that various characteristics of the light may be measured by TPS 202, such as the emitted wavelength, the intensity of the emitted light, and/or the decay of the emitted light. These measurements may therefore depend on the TPS device itself, including the optical detector utilized.

At block 320, TPS 202 may provide to controller 140 at least one signal having, for example, a voltage level that is based upon an amount of light detected at 315. The voltage level of the at least one signal can thus indicate an amount of residual toner detected. At block 325, controller 140 may compare the voltage level of the at least one signal received from TPS 202 with a predetermined threshold value. More particularly, if the voltage level of the signal is below the predetermined threshold value, which indicates that ITM belt 106 is sufficiently clean and no cleaning is necessary, then the next image transfer operation can be performed at block 330. On the other hand, if the voltage level of the at least one signal from TPS 202 exceeds the predetermined threshold value, indicating that the amount of residual toner on ITM belt 106 is sufficient to necessitate cleaning, an adjustment is performed on at least one operating characteristic of the cleaning unit 204 and/or the image forming device 100 at block 335. At block 340, controller 140 may then cause a cleaning operation to occur on ITM belt 106 using the adjusted operating characteristic.

Specifically, in the example embodiment illustrated in FIG. 2A, when the level of the signal provided by TPS 202 exceeds the predetermined threshold value, indicative that ITM belt 106 is not sufficiently clean of residual toner following a cleaning operation, controller 140 controls ITM belt drive 126 to rotate a section of ITM belt 106, without image transfer occurring. The cleaning unit 204 then cleans ITM belt 106 during a second pass thereof. In this case, the second pass of cleaning corresponds to the adjusted operating characteristic of cleaning unit 204 and/or image forming device 100 at 335 and the cleaning at 340. Additionally, during the second pass, the controller 140 may selectively increase at least one of the operating voltage and operating speed of the cleaning brush of cleaning unit 204 to provide an improved cleaning during the second pass.

In the example embodiments illustrated in FIGS. 2B and 2C, when the voltage level of the signal provided by TPS 202A exceeds the predetermined threshold value, thereby indicating that the amount of residual toner on ITM belt 106 is at an unacceptable level and necessitates cleaning, controller 140 may control the cleaning unit positioning mechanism 206 to move cleaning unit 204 into a position wherein the cleaning unit 204 engages ITM belt 106 and cleaning unit 204 may then clean ITM belt 106. In this case, movement of the cleaning unit 204 to engage ITM belt 106 may correspond to the adjusted operating characteristic of cleaning unit 204 and/or image forming device 100 at 335, and the subsequent cleaning may correspond to the cleaning at 340.

Similarly, in the example embodiment shown in FIG. 2D, when the signal provided by TPS 202A exceeds a second predetermined threshold value, which indicates that the amount of residual toner on ITM belt 106 is undesirably high and necessitates a more thorough cleaning, the cleaning unit positioning mechanism 206 may move cleaner blade 204A into a position wherein cleaner blade 204A engages ITM belt 106 and ITM belt 106 is cleaned with both cleaner blade 204A and cleaner brush 204B. In this case, the movement of the cleaner blade 204A to engage ITM belt 106 may correspond to the adjusted operating characteristic of cleaning unit 204 and/or image forming device 100 at 335, and the subsequent cleaning of ITM belt 106 may correspond to the cleaning at 340.

It is understood that the above-mentioned second predetermined threshold value may be different from the predetermined threshold value discussed above with respect to FIGS. 2A-2C because the second predetermined threshold value is used to decide between ITM belt 106 needing a gentle cleaning or a more thorough cleaning. When the signal provided by TPS 202A does not exceed the second predetermined threshold value, only the cleaner brush 204B engages and cleans ITM belt 106 of residual toner without use of cleaner blade 204A. In other words, the cleaner brush 204B is used when the signal provided by the TPS 202A falls below the second predetermined threshold value and the cleaner blade 204A is used along with the cleaner brush 204B when the signal provided by the TPS 202A exceeds the second predetermined threshold value.

It may be appreciated that any of the adaptable cleaning systems described above may be periodically calibrated by comparing a signal detected from a "clean belt"—one that has undergone multiple passes of cleaning—to a signal from a belt having a patch of toner deliberately forced to stay on the belt (e.g. by changing the second transfer voltage to a value that prohibits image transfer). Accordingly, the first and second predetermined threshold values may be based on this periodic calibration.

Further, in another contemplated example embodiment, TPS 202 may be optional and process 300 may be replaced by a determination by the controller of the type of print job. For example, after a determination that the pending or ongoing print job is a high toner volume print job (e.g., including a relatively large amount of solid graphics), controller 140 may control the cleaning unit positioning mechanism 206 to automatically move cleaning unit 204A into a position to engage ITM belt 106 so that a cleaning operation is automatically performed upon completion of the high toner volume print job. On the other hand, when the pending or ongoing print job is a low toner volume print job (e.g., a draft mode or text only print operation), controller 140 may control the cleaning unit positioning mechanism 206 to automatically move cleaning unit 204A into a disengaged position away from ITM belt 106 or otherwise refrain from engaging cleaning unit 204A and ITM belt 106. However, in this contemplated example embodiment, process 300 may still be performed to assess the effectiveness of the cleaning and determine if it is necessary to clean ITM belt 106 during a second pass.

In another contemplated example embodiment, controller 140 may control the cleaning unit positioning mechanism 206 to automatically move cleaning unit 204 (appearing in FIG. 2B or 2C) or cleaning unit 204A (appearing in FIG. 2D) into a position to engage ITM belt 106 upon resumption of a print job after a stoppage or interruption thereof, such as a media jam. In this embodiment, the cleaning operation is automatically performed to remove any untransferred toner image remaining on the ITM belt 106 prior to preparing ITM belt 106 to receive a new image, without sensing for residual toner by TPS 202. In this embodiment, with reference to FIG. 3, a determination may be made at 302 as to whether a media jam or other print job stoppage has immediately completed. Upon an affirmative determination, control may proceed directly to act 335, without first measuring the amount of toner appearing on ITM belt 106.

In yet another contemplated example embodiment, cleaning is automatically performed upon completion of toner density calibration. Toner density calibration is a method of calibrating an image forming device using a TPS wherein a plurality of toner patches may be deposited onto a control surface and signals indicative of the reflectivity of the plurality of toner patches from the control surface may then be used to adjust operating parameters of the image forming device. One such method is the method described in U.S. Pat. No. 7,995,939, assigned to the assignee of this application, the teachings of which are incorporated by reference herein in its entirety. In this embodiment, the cleaning operation is automatically performed to remove any toner patches on the ITM belt 106 prior to preparing ITM belt 106 to receive a new image, without first sensing for residual toner by TPS 202. With respect to the operation illustrated in FIG. 3, a determination may be made at 302 as to whether a TPS operation has immediately completed. Upon an affirmative determination, control may proceed directly to act 335, without first measuring the amount of toner appearing on ITM belt 106.

Figure 4:
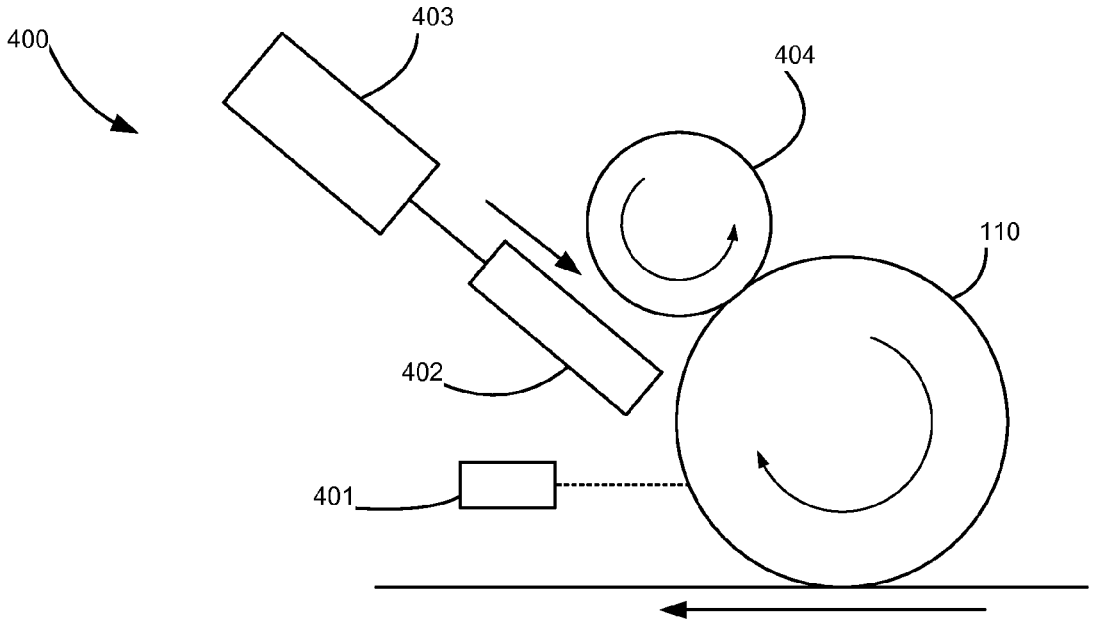
FIG. 4 shows an example embodiment of a cleaning unit for cleaning one or more photoconductor members depicted in FIG. 1.

In the example embodiments described above, the cleaning system is configured to clean ITM belt 106. In addition or in the alternative, the cleaning system may be used to clean each photoconductive member 110. It may be appreciated that in such alternative embodiments, residual toner on the photoconductive member 110 may be sensed with an excitation wavelength outside the range of wavelengths to which the photoconductive member 110 is receptive. With reference to FIG. 4, the photoconductive member cleaning apparatus 400 for each photoconductive member 110 may include TPS 401, cleaner blade 402, cleaner blade positioning mechanism 403 coupled to cleaner blade 402, and cleaner brush 404. Cleaning brush 404 may rotate in a direction opposite the rotation of photoconductive member 110. Cleaner blade 402 is normally positioned away from contact with photoconductive member 110 in its normal default position. Cleaner blade 402 may be configured to move into and out of engagement with photoconductive member 110 based on a signal provided by TPS 401 indicative of the amount of residual toner on photoconductive member 110 after image transfer.

It may be appreciated that the cleaning apparatus 400 may employ different combinations of some or all of cleaner blade positioning mechanism 403, cleaner blade 402, and cleaner brush 404 in performing the cleaning function, similar to the combinations of such components described with respect to the example embodiments of FIGS. 2A-2D. For instance, in an alternative embodiment, photoconductive member cleaning apparatus 400 may include only cleaning brush 404 and operate in a similar manner as described above with respect to the embodiment of FIG. 2A, or may include only cleaner blade 402 and cleaner blade positioning mechanism 403 and operate in a manner similar to the embodiment of FIG. 2C. In another alternative embodiment similar to the embodiment of FIG. 2B, cleaner blade positioning mechanism 403 may be used to move cleaning brush 404 into and out of contact with photoconductive member 110, wherein cleaning brush 404 may be normally in an out-of-contact position therewith.

Further, while FIG. 4 illustrates an example embodiment directed for use with each photoconductive member 110 shown in image forming device 100 of FIG. 1, it may also be appreciated that the example embodiment may be used in a monochrome printer (for cleaning a single photoconductive member 110) or a color printer in which toner is transferred from each photoconductive member 110 directly to the media sheet.

The foregoing description of methods and example embodiments of the disclosure have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An imaging device, comprising:

an assembly having a moving surface for transferring a developed toner image from the moving surface during an image transfer operation;

a sensing unit operative to detect a reflectance of the moving surface, the reflectance indicative of an amount of residual toner on the moving surface;

a cleaning unit for cleaning residual toner from the moving surface after the image transfer operation; and a controller communicatively connected to the assembly, the sensing unit, and the cleaning unit, the controller operative to selectively adjust an operating characteristic of the cleaning unit based on the reflectance detected by the sensing unit, wherein immediately after the image transfer operation, and before any cleaning is done, the sensing unit detects the reflectance of the moving surface, the cleaning unit cleans the moving surface in one pass when a first reflectance detected by the sensing unit exceeds a threshold value, and in two passes when a second reflectance detected by the sensing unit after the one pass still exceeds the threshold value.

2. The imaging device of claim 1, wherein the cleaning unit comprises a rotatable brush and a blade, the brush is controlled by the controller to clean the moving surface in the one pass when a first reflectance detected by the sensing unit exceeds the threshold value and the blade is controlled by the controller to clean the moving surface along with the brush when a second reflectance detected by the sensing unit after the one pass still exceeds the threshold value.

3. The imaging unit of claim 2, wherein the rotatable brush is positioned downstream of the blade along the moving surface.

4. The imaging device of claim 1, wherein the controller is operative to move a section of the moving surface, without performing image transfer, for further cleaning by the cleaning unit based on the reflectance detected by the sensing unit.

5. The imaging device of claim 1, wherein the adjusted operating characteristic of the cleaning unit is an operating speed of the cleaning unit.

6. The imaging device of claim 1, wherein the sensing unit is positioned downstream of the cleaning unit along the moving surface.

7. The imaging device of claim 1, wherein the sensing unit is positioned upstream of the cleaning unit along the moving surface.

8. The imaging device of claim 1, wherein the moving surface comprises a photoconductive member, and the sensing unit detects light reflected by the residual toner at a wavelength outside a range of wavelengths to which the photoconductive member is receptive.

9. The imaging device of claim 1, wherein the sensing unit detects at least one of intensity and decay of light reflected by the residual toner.

* * * * *